United States Patent [19]

Killop

[11] 4,028,922

[45] June 14, 1977

[54] APPARATUS AND METHOD FOR SPLINING POWER TRANSMISSION MEMBERS

[75] Inventor: James Thomas Killop, Warren, Mich.

[73] Assignee: Anderson-Cook, Inc., Fraser, Mich.

[22] Filed: Oct. 15, 1976

[21] Appl. No.: 732,682

[52] U.S. Cl. ..... 72/88; 72/469

[51] Int. Cl.[2] ..... B21D 9/14; B21D 53/28

[58] Field of Search ..... 72/88, 90, 469

[56] References Cited

UNITED STATES PATENTS 3,982,415 9/1976 Killop ..... 72/88

*Primary Examiner*—Milton S. Mehr

*Attorney, Agent, or Firm*—Reising, Ethington, Barnard, Perry and Brooks

[57] ABSTRACT

Apparatus and a method for splining annular thin wall power transmission members in a manner that provides precise spline formation and accurately maintains the roundness of the splined members. A toothed pinion type mandrel of the apparatus mounts a power transmission member to be splined between a pair of cooperable dies of the apparatus. Each die has at least one first tooth group and a second tooth group, and teeth of each tooth group are spaced therealong with the teeth of the first group spaced farther from each other than the teeth of the second group. Driving of the dies relative to each other and the power transmission member mounted on the mandrel initially engages the farther spaced teeth with the mounted transmission member so as to cooperate in a meshing relationship with the toothed mandrel with the power transmission member therebetween to form a first set of splines. Subsequent movement of the dies engages the closer spaced teeth with the power transmission member to mesh with the first set of splines therein while concomitantly cooperating in a meshing relationship with the toothed mandrel with the power transmission member therebetween to form a second set of splines intermediate the first set of splines. Still subsequent driving movement of the dies again engages the splined power transmission member with the farther spaced teeth to mesh with the splines while skipping at least alternating locations therebetween to correct any out of roundness of the member.

14 Claims, 15 Drawing Figures

APPARATUS AND METHOD FOR SPLINING POWER TRANSMISSION MEMBERS

BACKGROUND OF THE INVENTION

1. Field of the Invention

The present invention relates generally to apparatus and a method for forming splines in an annular thin wall power transmission member, and more particularly to such apparatus and a method which incorporate a toothed pinion type mandrel for mounting the power transmission member to the splined and also incorporate a pair of cooperable dies that are driven on opposite sides of the mandrel mounted member to mesh with the mandrel teeth with the member therebetween in a manner that provides the spline formation.

2. Description of the Prior Art

United States patent application Ser. No. 606,398, filed Aug. 21, 1975 and assigned to the assignee of the present invention, and now U.S. Pat. No. 3,982,415, the entire disclosure of which is hereby incorporated by reference, discloses apparatus and a method for splining power transmission members. A toothed mandrel and a pair of cooperable dies of the apparatus are used in the spline forming operation disclosed. An annular thin wall power transmission member to be splined is mounted on the toothed mandrel and rotatably supported thereby between opposed forming faces of the dies. Die teeth spaced along the forming faces mesh with teeth of the mandrel during die movement with the power transmission member therebetween so as to form the splines.

Certain annular power transmission members, such as clutch hubs, include an end wall and an axial sleeve portion projecting from the end wall with an open end defined opposite the end wall. In splining the sleeve portion of such annular power transmission members, it is important not only to form accurate splines but also to maintain the roundness of the sleeve portion. Adjacent the end wall, the sleeve portion is more rigid than adjacent its open end. This difference in rigidity makes it difficult to maintain the sleeve portion diameter without forming a "bell mouth" shape that is of a larger diameter at the open end of the sleeve portion than adjacent the end wall. Also, it is difficult to maintain the sleeve portion roundness with a constant diameter in all radial directions when splines are formed therein with this toothed mandrel and cooperable dies splining operation. This is particularly the case when the splines being formed are relatively shallow, i.e. of a depth less than twice the thickness of the sleeve portion being splined.

Formation of precise splines on uniform diameter power transmission members is important since these splines must mate with other power transmission components to transfer rotary power. For example, with the clutch hubs previously discussed, clutch discs are stacked and have splines that mate with the splines of the clutch hub sleeve portion. The clutch discs may be located within the sleeve portion so that their outer peripheries are splined to mate with the interior of the splined sleeve portion or, conversely, the clutch discs may have central openings that receive the sleeve portion and are splined to mate with the exterior of the sleeve portion.

United States patents relating to splining or other similar forming are: U.S. Pat. Nos. 1,670,476; 2,886,990; 2,994,237; 3,015,243; 3,407,638; 3,630,058; and 3,672,203.

SUMMARY OF THE INVENTION

An object of the present invention is to provide apparatus and a method for splining annular thin wall power transmission members with precise splines while maintaining the roundness of the members being splined.

Another object of the invention is to provide apparatus and a method for splining annular power transmission members having an end wall and a sleeve portion with an open end opposite the end wall, the splines being formed precisely in the sleeve portion without imparting any out of roundness thereto or any bell mouth shape having a larger diameter adjacent the open end of the sleeve portion than adjacent the end wall.

In carrying out the above objects, apparatus according to the invention used in accordance with the method thereof incorporates a toothed pinion type mandrel for rotatably mounting a power transmission member to be splined and also incorporates a pair of cooperable dies having forming faces that oppose each other on opposite sides of the mandrel mounted power transmission member. Each forming face has at least one first tooth group and a second tooth group, with teeth spaced along each tooth group, and with the teeth of the first tooth group being spaced farther from each other than the teeth of the second tooth group. Driving of the dies relative to each other and the power transmission member mounted on the mandrel initially engages the farther spaced teeth with the mounted power transmission member in a meshing relationship with the toothed mandrel to form a first set of splines in the member. Subsequent die movement engages the closer spaced teeth of the second tooth group with the power transmission member so as to mesh with the first set of splines therein while concomitantly cooperating in a meshing relationship with the toothed mandrel to form a second set of splines in the member intermediate the first set of splines. The dies are then driven relative to the splined power transmission member to mesh farther spaced teeth of the dies with the splines while skipping at least alternating locations between the splines in a manner that corrects any out of roundness of the splined member.

In one preferred embodiment, the dies are reciprocably driven during the splining so that the first tooth group forming the first set of splines subsequently meshes with the splined member to provide the correction of any out of roundness. A second preferred embodiment has another tooth group of farther spaced teeth located on the opposite side of the closer spaced teeth of the second tooth group from the first tooth group that forms the first set of splines. Splining of the power transmission member and correction of any out of roundness is thus accomplished with the latter embodiment during driving of the dies in a single direction relative to each other and the member being splined. The dies of both preferred embodiments are in the form of elongated gear racks and are driven rectilinearly during the splining.

To spline annular power transmission members which include an end wall and a thin wall sleeve portion with an open end opposite the end wall, both preferred embodiments include partial teeth located between the farther spaced teeth of the first tooth group that forms the first set of splines. The partial teeth are located in an alternating relationship with the teeth of the first tooth group so that these teeth are spaced from each other twice the distance as the spacing between the teeth of the second tooth group that forms the second set of splines intermediate the first set of splines. During formation of the first set of splines, the partial teeth engage the open end of the sleeve portion and form end depressions in a manner that maintains the diameter of the sleeve portion the same at the open end thereof as adjacent the end wall. Partial teeth are also located between the farther spaced teeth that provide the out of roundness correction in the unidirectionally driven embodiment of the dies. Support for the open end of the sleeve portion is thus provided in both embodiments during the correction of the out of roundness.

A toothed synchronizer on the mandrel is located in an axially spaced relationship from a mounted power transmission member to be splined. Each tooth and partial tooth of the tooth groups includes a synchronizing tooth portion that meshes with the toothed synchronizer on the mandrel to synchronize the mandrel rotation with the die movement during the splining operation. This synchronization is most important during engagement of the power transmission member being splined with the farther spaced teeth during formation of the first set of splines and during correction of the out of roundness. Synchronizing teeth on one die of each embodiment provide commencement of mandrel rotation prior to the initial tooth engagement that forms the first set of splines. Mounting flanges at leading and trailing ends of the dies provide mounting thereof on a machine that embodies the apparatus.

Mounting holes in the end wall of power transmission members may be utilized to index the members relative to the mandrel. Lubrication ports formed in the sleeve portion of each power transmission member are positioned by the indexing so as to be located between the projecting splines that are formed by the splining operation. Formation of the lubrication ports prior to the splining is advantageous since there is thus no work hardening of the sleeve portion when the lubrication ports are formed.

The objects, features and advantages of the present invention are readily apparent from the following detailed description of the preferred embodiments taken in connection with the accompanying drawings.

DETAILED DESCRIPTION OF THE PREFERRED EMBODIMENTS

Figure 1:
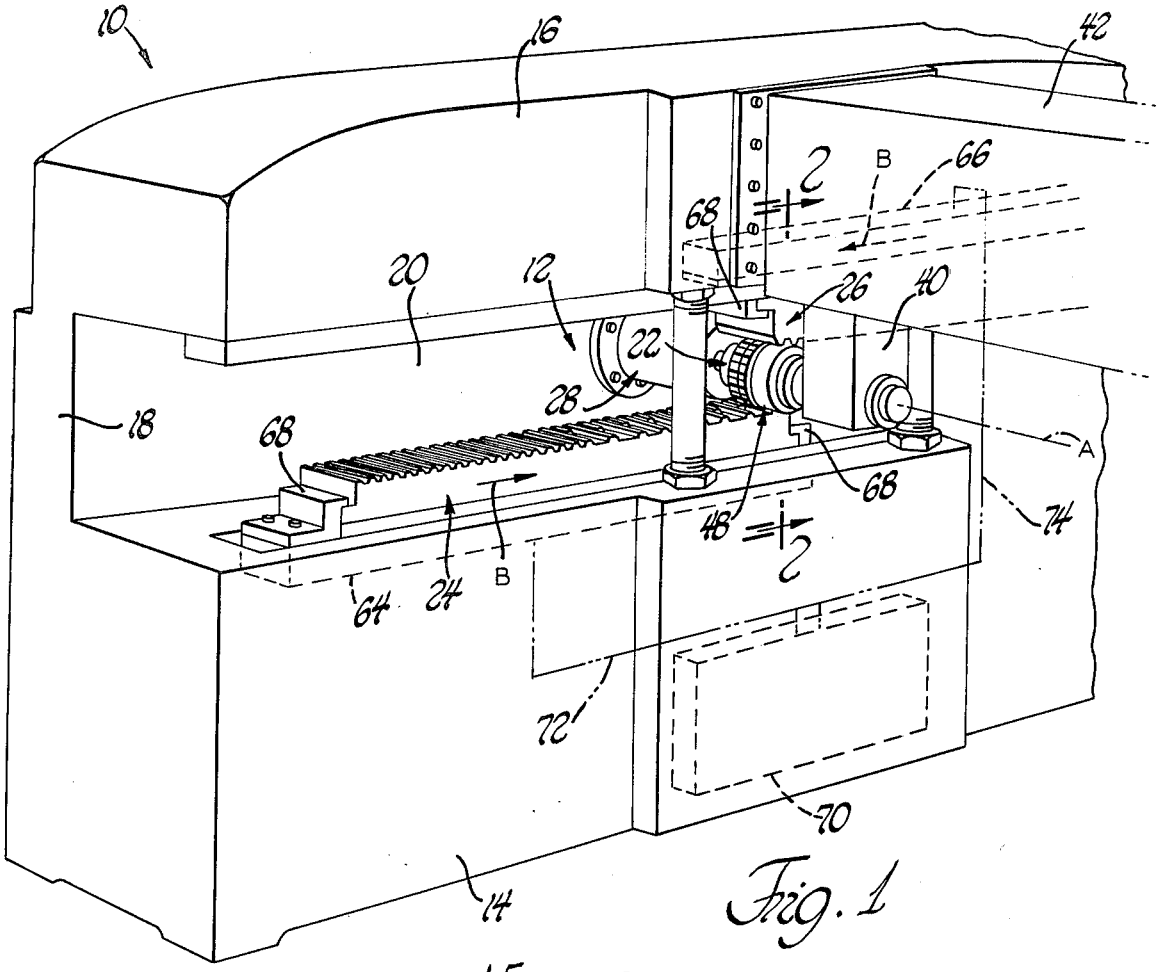
FIG. 1 is a perspective view of a spline forming machine including apparatus embodying the present invention.

Referring to FIG. 1 of the drawings, a machine indicated by 10 includes spline forming apparatus collectively indicated by 12 according to the present invention. The lower floor supported base 14 of the machine supports the apparatus in cooperation with an upper machine portion 16 and a support portion 18. Between the base 14 and the upper portion 16 forwardly of the support portion 18, a work space 20 is defined to receive the spline forming apparatus 12.

Figure 2:
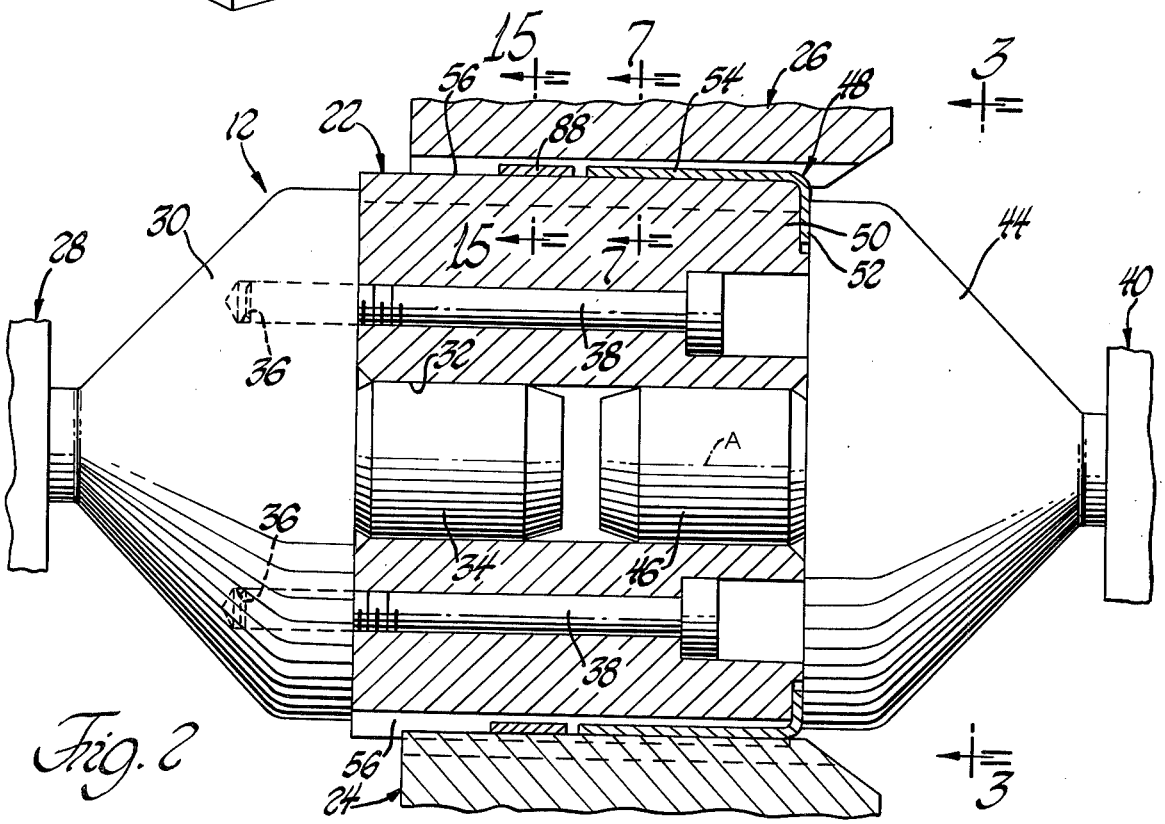
FIG. 2 is a sectional view through apparatus of the invention taken along line 2—2 of FIG. 1.
Figure 5:
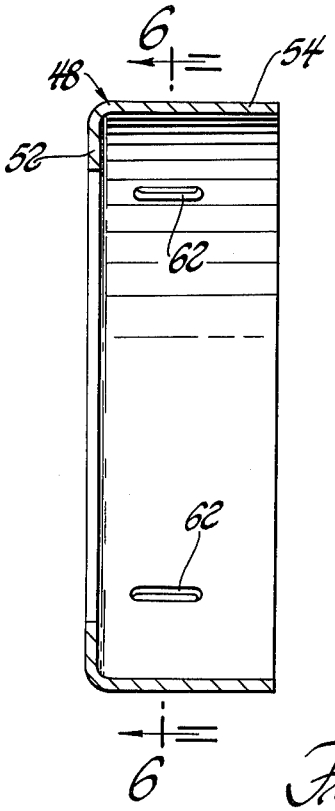
FIG. 5 is a sectional view taken along a diameter of a power transmission member to be splined by apparatus of the invention.
Figure 6:
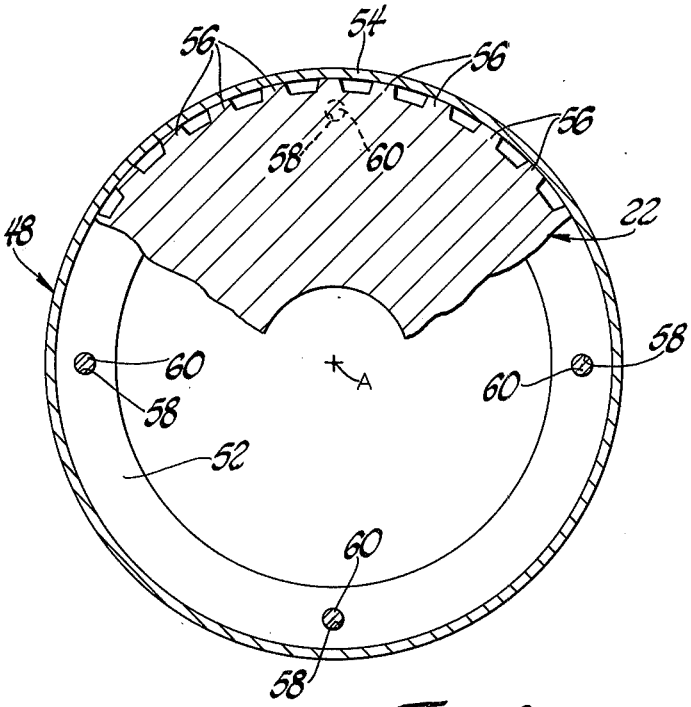
FIG. 6 is a sectional view taken along line 6—6 of FIG. 5 and showing a mandrel of the apparatus that is used in the spline forming operation.

With combined reference to FIGS. 1 and 2, spline forming apparatus 12 includes a toothed pinion type mandrel 22 and a pair of cooperable dies 24 and 26 of the rectilinearly elongated gear rack type. A headstock 28 of the machine includes a rotatable spindle 30 on which the mandrel 22 is mounted for rotation about an axis A. A central hole 32 in the mandrel concentric about axis A receives a round shaft 34 of the headstock spindle 30 and recessed bolt holes 36 in the spindle receive attachment bolts 38 that are threaded into the headstock spindle to secure the mandrel. A tailstock 40 of the machine is slidably supported on the lower side of an upper support arm 42 for movement toward and away from the headstock 28 along the direction of axis A. A rotatable spindle 44 of the tailstock includes a shaft 46 received within the opposite end of the mandrel hole 32 as the headstock spindle shaft 34. Movement of the tailstock 40 forwardly (to the right as in FIG. 2) withdraws the tailstock spindle shaft portion 46 from the mandrel hole 32 and allows an annular power transmission member 48 to be mounted on an end 50 of the mandrel ready for a splining operation to be performed. Subsequent rearward movement of the tailstock 40 (to the left as in FIG. 2) causes insertion of the tailstock spindle shaft 46 into the mandrel hole 32 to provide support to the mandrel as the periphery of the tailstock spindle 44 axially engages an annular end wall 52 of the power transmission member in a clamping relationship with the mandrel end 50. An annular thin wall sleeve portion 54 of the mounted power transmission member 48 receives the mandrel 22 with its interior engaged by mandrel teeth 56 as shown in FIG. 6. Also, end wall 52 includes mounting holes 58 (FIG. 6) used to mount the power transmission member 48 after it has been splined. Indexing pins 60 on the mandrel may be provided so as to be received within the end wall holes 58 so that preformed lubrication ports 62 (FIG. 5) in the power transmission sleeve portion 54 are circumferentially positioned at predetermined locations to be properly located relative to the splines to be formed in the manner hereinafter described. Opposite the end wall 52, sleeve portion 54 has an open end as seen in FIG. 5.

As seen in FIG. 1, schematically indicated rectilinear drive actuators 64 and 66 include attachment members 68 for mounting the associated dies 24 and 26 and driving these dies rectilinearly along the direction of arrows B. A schematically indicated driving means 70 is coupled to the actuators 64 and 66 by respective schematically indicated connections 72 and 74 that may be either mechanical gearing, hydraulic, or electrical connections for driving the dies. Also, the drive means is reversible once the dies have moved into an overlapping relationship from the position shown in a manner that is hereinfter described.

Figure 3:
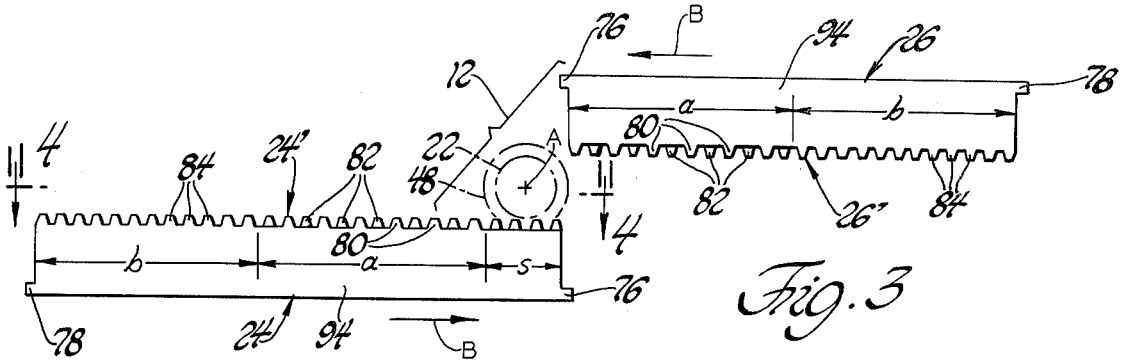
FIG. 3 is a side elevation view of the apparatus taken along line 3—3 of FIG. 2.

Reference should now be made to FIG. 3 which further illustrates the gear rack forming dies 24 and 26. Each die includes a metallic body with a leading end having a mounting flange 76 and a trailing end having a mounting flange 78. Forming faces 24' and 26' of the metallic die bodies oppose each other on opposite sides of the schematically indicated power transmission member 48 mounted on the schematically indicated mandrel 22. Adjacent the leading end of each die 24 and 26, a die section *a* includes a first tooth group having full and partial teeth 80 and 82 arranged in an alternating relationship. Each die 24 and 26 also includes a die section *b* trailing its die section *a* and having a second group of full teeth 84. The one die 24 also includes a die section *s* preceding the die section *a* at the leading end thereof and having synchronizing teeth 86.

Figure 4:
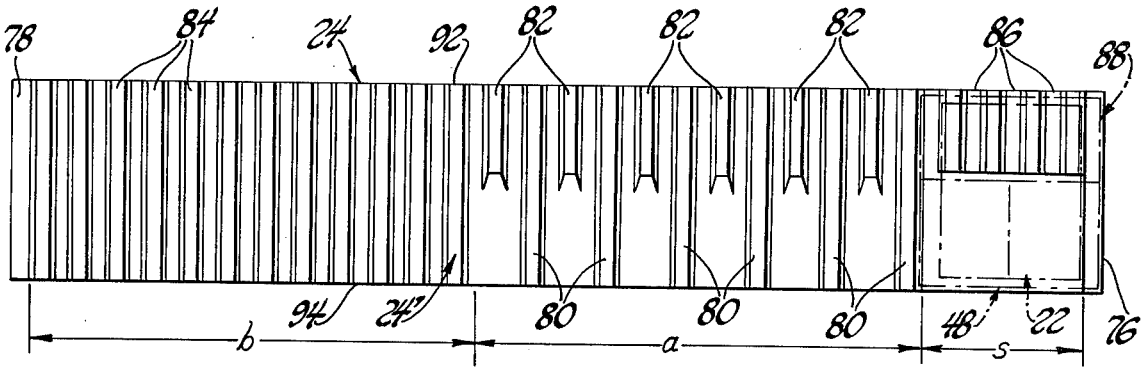
FIG. 4 is a top plan view of a spline forming die of the apparatus taken along line 4—4 of FIG. 3.

With combined reference to FIGS. 2, 3, 4 and 15, a synchronizer 88 of ring shape has a wall thickness equal to the wall thickness of the sleeve portion 54 on the power transmission member 48 to be splined. Synchronizer 88 is formed to include teeth 90 (FIG. 15) that overlie the mandrel teeth 56 in an axially spaced relationship with respect to the mounted power transmission member 48 along the rotatable axis A. Synchronizer teeth 90 mesh with the synchronizing teeth 86 of the die 24 shown in FIG. 4 as the dies are driven into an overlapping relationship along the direction of arrows B by the drive means previously described. Rotation of mandrel 22 thus commences with the commencement of die movement. Also, as illustrated by FIG. 4, each die has one side wall 92 adjacent which its teeth 80, 82, and 84 are longitudinally aligned so as to mesh with the synchronizer 88 and synchronize the mandrel rotation with the dies throughout the die movement along the total length of sections *a* and *b*. However, partial teeth 82 do not extend completely to the other side wall 94 of the die. These partial teeth 82 terminate at aligned locations so as to just engage the open end of the power transmission member sleeve portion 54 opposite end wall 52 during the splining as is described later. The full teeth 80 of the first tooth group along die section *a* are spaced with respect to each other twice the distance as the teeth 84 of the second tooth group spaced along die section *b*.

Figure 7:
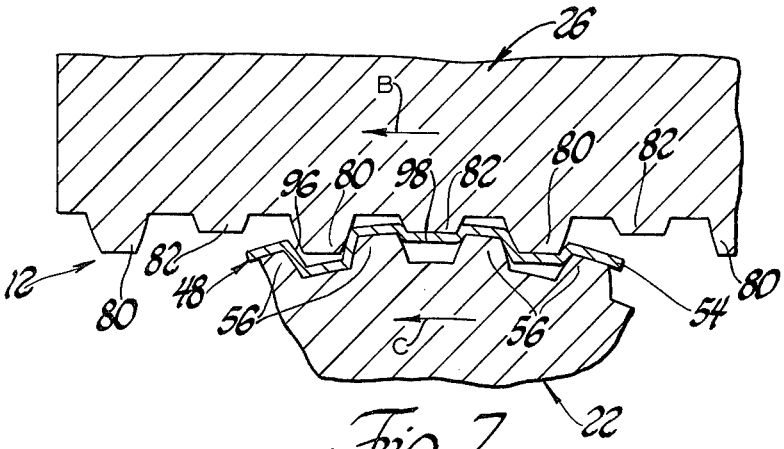
FIG. 7 is a sectional view taken along line 7—7 of FIG. 2 and shows the spline forming apparatus during an initial stage of the spline forming operation.
Figure 9:
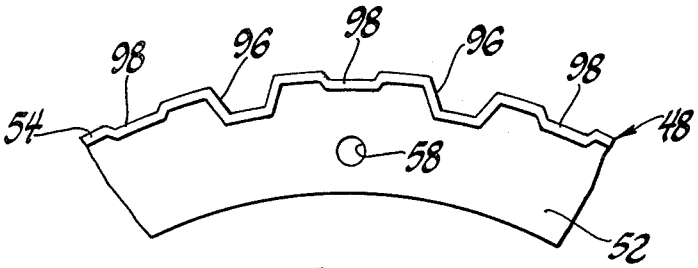
FIG. 9 is a partial end view of the power transmission member taken along line 9—9 of FIG. 8.
Figure 8:
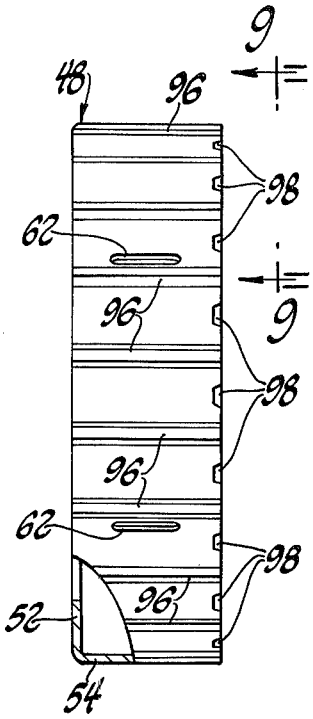
FIG. 8 is a side view of a power transmission member after it has gone through the steps of the spline forming operation shown in FIG. 7.

With reference to FIG. 7, splining of the power transmission sleeve portion 54 proceeds as shown with the mandrel 22 rotating in the direction of arrow C by the synchronization previously discussed. Teeth 80 of the first tooth group mesh with the mandrel teeth 56 with the sleeve portion 54 therebetween to form a first set of splines 96 in the sleeve portion as shown in FIGS. 8 and 9. Partial teeth 82 of the first tooth group terminate so as to just engage the open end of the sleeve portion opposite its end wall 52 at locations intermediate the splines 96 being formed and thereby form end depressions 98. Formation of the end depressions 98 provides support for the open end of the sleeve portion 54 opposite the power transmission member end wall 52 and thereby prevents the sleeve portion from taking on a bell mouth shape with a larger diameter adjacent the open end than adjacent the end wall. The end depressions 98 are relatively short in axial length and, as seen in FIG. 9, are relatively shallow in relationship to the first set of splines 96. Each spline 96 and end depression 98 is formed on one side of the axis of mandrel rotation A (FIG. 3) while another similar spline or end depression is being formed at a diametrically opposed position on the opposite side of the axis by the other die. It has been found preferable for the die sections *a* illustrated in FIGS. 3 and 4 to have a length equal to the circumference of the power transmission member 48 so that each spline 96 shown in FIG. 8 is again meshed with another tooth on the opposite die after its formation to ensure precise formation of the spline.

Figure 10:
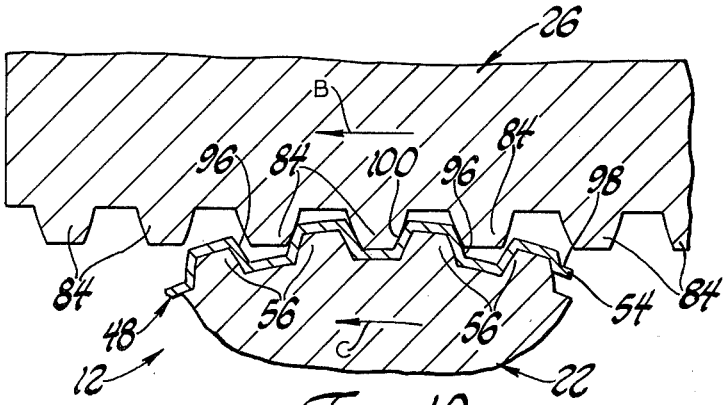
FIG. 10 is a view taken in the same direction as FIG. 7 during a later stage of the spline forming operation.
Figure 12:
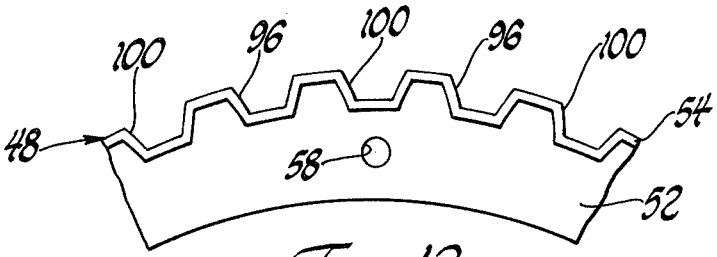
FIG. 12 is an end view of the power transmission member taken along line 12—12 of FIG. 11.
Figure 11:
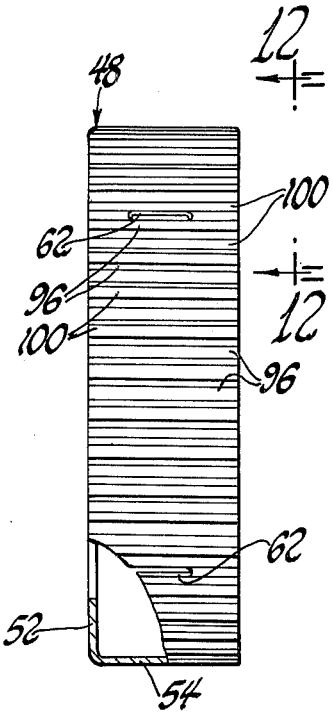
FIG. 11 is a side view of a power transmission member that has gone through the stage of the spline forming operation shown in FIG. 10.

After the dies 24 and 26 have been moved sufficiently far in the direction of arrows B so that the teeth 80 and 82 of die sections *a* disengage the power transmission member 48 and the teeth 84 of the die sections *b* engage the power transmission member at diametrically opposed positions, the die tooth and power transmission member engagement then is as shown in FIG. 10. Alternating die teeth 84 then mesh with the first set of splines 96 while the other alternating die teeth 84 mesh with the mandrel teeth 56 with the sleeve portion 54 interposed between the die teeth and the mandrel teeth in alignment with the end depressions 98. A second set of splines 100 is thus formed by the die teeth 84 intermediate the first set of splines 96 at the locations where the end depressions 98 formed by the partial teeth 82 were previously located. Splines 96 and 100 have the same length and depth as each other as shown by FIGS. 11 and 12. The length of each die section *b* shown in FIGS. 3 and 4 is preferably equal to the circumference of the power transmission member 48 being splined so that each spline 96 and 100 is engaged with a die tooth 84 along the die section *b* of both dies 24 and 26.

After the dies 24 and 26 have been moved in the direction of arrows B sufficiently so that their trailing ends adjacent the mounting flanges 78 are located below and above the axis of mandrel rotation A, the drive means previously described reverses the direction of die movement so that the dies are driven in the directions opposite to arrows B. Splined members removed prior to commencement of this reverse driving have been found to have an out of round condition. Likewise, splined members removed after having been meshed with the die teeth 84 along the full length of die sections *b* during the reverse driving have also been found to still have this out of roundness. However, subsequent reverse driving of the dies 24 and 26 which meshes the splined member 48 with the farther spaced teeth 80 of the first tooth group along die sections *a* has been found to remove the out of roundness previously present with the splined members. As the out of roundness is corrected, the die teeth 80 mesh with the splines 96 and 100 at alternating locations therebetween while the partial teeth 82 engage the open end of the spline sleeve portion 54 opposite the end wall 52 to prevent any bell mouth distortion of the sleeve portion.

Splining by the apparatus and method described is most helpful when the splines being formed have a depth less than two times the wall thickness of the member being splined. However, this apparatus and method have also been found to be helpful when deeper splines are being formed. Reduction of the tooth load during forming of each spline by the apparatus and method disclosed is believed to be one reason why precise splines can be generated. Likewise, during formation of each spline, there is a greater separation from the next spline being formed and there is less of a tendency for the sleeve portion to be pulled out from between the mandrel and die teeth forming the spline. Also, the manner in which the splines are meshed with the splined member while skipping at least alternating locations therebetween is helpful in correcting the roundness because there is then sufficient spacing for the sleeve portion to be deformed to correct for this out of roundness between the locations of the meshing.

The preformed lubrication port 62 can be accurately located between the splines 96 and 100 shown in FIG. 11 due to the indexing provided during mounting of the power transmission member on the mandrel 22. As previously discussed, this indexing is provided by the cooperable action of the mounting holes 58 in the power transmission end wall 52 and the indexing pins 60 on the mandrel.

Figure 13:
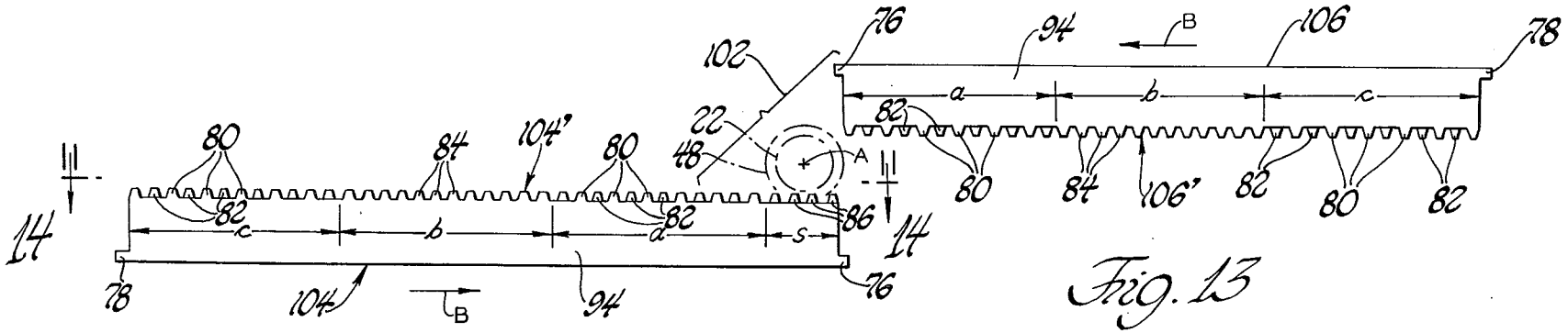
FIG. 13 is a view taken in the same direction as FIG. 3 of another embodiment of apparatus according to the invention.
Figure 14:
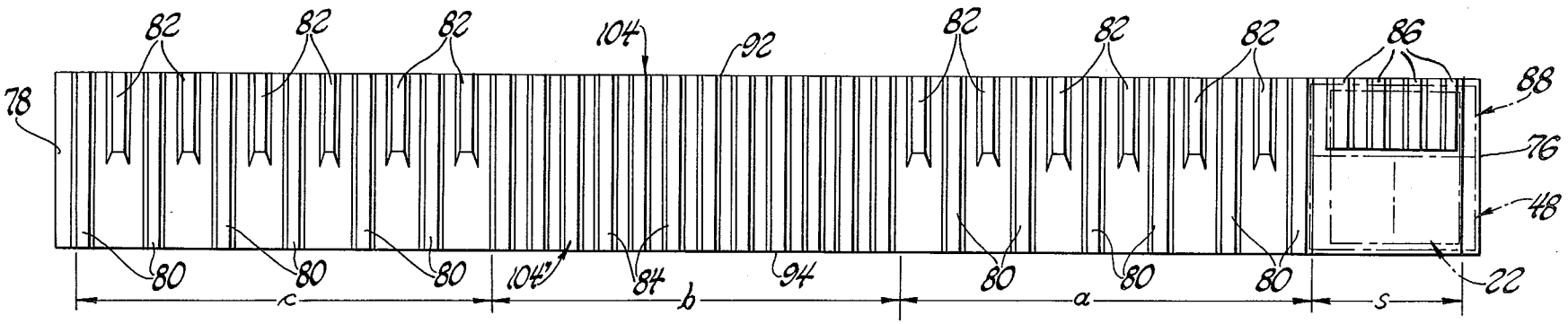
FIG. 14 is a top plan view taken along line 14—14 of FIG. 13 showing a spline forming die of the apparatus thereof.
Figure 15:
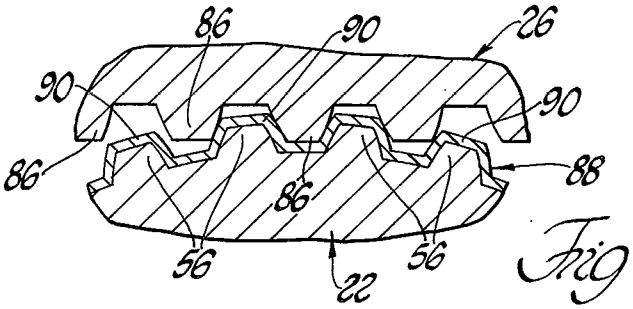
FIG. 15 is a sectional view taken along line 15—15 of FIG. 2 showing the meshing relationship between a mandrel synchronizer and mandrel synchronizing tooth portions of a spline forming die of the apparatus.

Referring to FIG. 13, another preferred embodiment of apparatus constructed according to the present invention and used in accordance with the method thereof is collectively indicated by reference numeral 102 and includes a pair of cooperable dies 104 and 106. Except for a modification that will be noted, these dies 104 and 106 are similar to the dies 24 and 26 shown in FIGS. 3 and 4, and like reference numerals are thus used to indicate corresponding components. As can be seen, the dies 104 and 106 include metallic bodies having forming faces 104' and 106' provided with toothed die sections *a* and *b* of a construction identical to the dies previously described. Die 104 also includes a synchronizing die section *s* like the one die previously described. Likewise, the dies are utilized with a toothed mandrel 22 like the mandrel previously described. Thus, forming faces 104' and 106' have teeth 80, 82, and 84 along die sections *a* and *b* and synchronizing teeth 86 whose function is the same. However, each die is also provided with a die section *c* located on the opposite side of its die section *b* from its die sections *a* toward the trailing end of the die. Die sections *c* (see also FIG. 14) have full teeth 80 and partial teeth 82 arranged in an alternating relationship with the identical construction as the die teeth along the die section *a*. With the mandrel 22 and dies 104 and 106 of apparatus 102 mounted on a machine 10 in the same manner as the dies shown in FIG. 1, splining takes place during movement of the dies along the direction of arrows B without any requirement for reversal of the direction of die movement. The teeth 80 and 82 along die sections *a* of dies 104 and 106 form the first set of splines and the end depressions in the power transmission member in the same manner previously discussed. Likewise, the teeth 84 of the die sections *b* form the second set of splines intermediate the first set. However, after completion of the splining by the die sections *b*, the dies continue to be driven in the same direction along arrows B without reversal to engage the teeth 80 and partial teeth 82 of die sections *c* with the splined member in the same manner accomplished with the other embodiment by the reversed driving through the die sections *a* a second time. Out of roundness is thus corrected by the die sections *c* in the same manner previously discussed but with the dies moved in the same direction as during the spline forming that takes place with the die sections *a* and *b*.

Also, although the two preferred embodiments herein disclosed incorporate gear rack type dies, the dies may also be formed with partially circular forming faces as disclosed in U.S. Pat. application Ser. No. 711,673, filed Aug. 4, 1976 and assigned to assignee of the present invention. The entire disclosure of this prior application being incorporated by reference in the present application.

Other embodiments of the apparatus and methods for practicing the present invention other than the preferred ones herein disclosed are apparent to those skilled in the art in order to practice the invention as defined by the following claims.

I claim:

1. Apparatus for forming splines in an annular thin wall power transmission member, the apparatus comprising:

a rotatable pinion type mandrel for mounting the power transmission member, said mandrel including outwardly projecting teeth;

a pair of cooperable dies having forming faces that oppose each other, each forming face having at least one first tooth group and a second tooth group, and each forming face having teeth spaced therealong and the teeth of the first group being spaced further from each other than the teeth of the second group; and means for moving the dies relative to each other and the power transmission member mounted on the mandrel to:

1. initially engage the farther spaced teeth with the mounted power transmission member so as to cooperate in a meshing relationship with the toothed mandrel and thereby form a first set of splines in the member;
2. subsequently engage the closer spaced teeth with the power transmission member to mesh with the first set of splines therein while concomitantly cooperating in a meshing relationship with the toothed mandrel to form a second set of splines in the member intermediate the first set of splines; and
3. finally engage the farther spaced teeth with the splined power transmission member to mesh with the splines while skipping at least alternating locations between the splines to correct any out of roundness of the member.

2. Apparatus for forming splines in an annular power transmission member including an end wall and a thin wall sleeve portion with an open end opposite the end wall, the apparatus comprising:

a rotatable pinion type mandrel for mounting the power transmission member, said mandrel including outwardly projecting teeth that engage the interior of the sleeve portion on the mounted power transmission member;

a pair of cooperable dies having forming faces that oppose each other, each forming face having at least one first tooth group and a second tooth group, each forming face having teeth spaced therealong, and the teeth of the first group being spaced twice as far from each other as the teeth of the second group, and partial teeth located between the teeth of said one first tooth group on each forming face;

means for moving the dies relative to each other and the power transmission member mounted on the mandrel to:

1. initially engage the farther spaced teeth with the sleeve portion of the mounted power transmission member so as to cooperate in a meshing relationship with the toothed mandrel and thereby form a first set of splines in the sleeve portion while the partial teeth form end depressions in the open end of the sleeve portion between the first set of splines in a manner that maintains the diameter of the sleeve portion the same at the open end thereof as adjacent the end wall;
2. subsequently engage the closer spaced teeth with the sleeve portion of the power transmission member to mesh with the first set of splines therein while concomitantly cooperating in a meshing relationship with the toothed mandrel to form a second set of splines in the sleeve portion at the locations of the end depressions intermediate the first set of splines; and
3. finally engage farther spaced teeth with the splined sleeve portion of the power transmission member to mesh with the splines at alternating locations between the splines in a manner that corrects any out of roundness of the sleeve portion.

3. Apparatus as claimed in claim 2 wherein the means for moving the dies includes a reversible drive that:

moves the dies relative to the mandrel and each other in a first direction to engage said one first tooth group and the second tooth group of each die forming face with the sleeve portion of the power transmission member so as to thereby form the first and second sets of splines, and moves the dies relative to the mandrel and each other in a second direction opposite the first direction to again engage said one first tooth group of each die with the power transmission member to mesh with the formed splines at alternating locations therebetween so as to provide the correction of any out of roundness of the sleeve portion.

4. Apparatus as claimed in claim 2 wherein the forming face of each die includes two tooth groups of farther spaced teeth with the group of closer spaced teeth located therebetween, and the means for moving the dies including a drive that moves the dies relative to the mandrel and each other in one direction during the splining and thereby:

1. initially engages said one first tooth group of farther spaced teeth on each forming face with the sleeve portion to form the first set of splines and the end depressions,
2. subsequently engages the second group of closer spaced teeth on each forming face with the second set of splines; and
3. finally engages the other group of farther spaced teeth on each forming face with the formed splines in the sleeve portion to correct any out of roundness.

5. Apparatus as claimed in claim 2 further including a toothed synchronizer on the mandrel and a synchronizing tooth portion on each tooth and partial tooth of the tooth groups, and said synchronizing tooth portions meshing with the toothed synchronizer on the mandrel to synchronize the mandrel rotation with the die movement throughout the spline forming operation.

6. Apparatus for forming splines in an annular power transmission member including an end wall and a thin wall sleeve portion with an open end opposite the end wall, the apparatus comprising:

a rotatable pinion type mandrel for mounting the power transmission member, said mandrel including outwardly projecting teeth that engage the interior of the sleeve portion on the mounted power transmission member;

a pair of cooperable gear rack type dies having elongated forming faces that oppose each other, each forming face having a first tooth group and a second tooth group, said tooth groups each having teeth spaced therealong and the teeth of the first group being spaced twice as far from each other as the teeth of the second group, and partial teeth located between the teeth of the first tooth group on each forming face; and reversible means for moving the dies relative to each other and the power transmission member mounted on the mandrel:

a. in a first direction to initially engage the first group of farther spaced teeth on each forming face with the mounted power transmission member so as to cooperate in a meshing relationship with the toothed mandrel and thereby form a first set of splines in the sleeve portion while the partial teeth form end depressions in the open end of the sleeve portion between the first set of splines in a manner that maintains the diameter of the sleeve portion the same at the open end thereof as adjacent the end wall;

subsequently engage the second group of closer spaced teeth on each forming face with the sleeve portion of the power transmission member to mesh with the first set of splines therein while concomitantly cooperating in a meshing relationship with the toothed mandrel to form a second set of splines in the sleeve portion at the locations of the end depressions intermediate the first set of splines; and b. in a second direction to finally again engage the first group of farther spaced teeth on each forming face with the splined sleeve portion of the power transmission member to mesh with the formed splines thereof at alternating locations between the splines to correct any out of roundness of the member.

7. Apparatus for forming splines in an annular power transmission member with an open end opposite the end wall, the apparatus comprising:

a rotatable pinion type mandrel for mounting the power transmission member, said mandrel including outwardly projecting teeth that engage the interior of the sleeve portion on the mounted power transmission member;

a pair of cooperable gear rack type dies having elongated forming faces that oppose each other, each forming face having a spaced pair of first tooth groups and a second tooth group located therebetween, said tooth groups each having teeth spaced therealong and the teeth of each first group being spaced twice as far from each other as the teeth of the second group, and the spaced first tooth groups on each forming face having partial teeth located between the spaced teeth thereof; and means for moving the dies relative to each other and the power transmission member mounted on the mandrel to:

1. initially engage one of the first tooth groups of farther spaced teeth on each forming face with the sleeve portion on the mounted power transmission member so as to cooperate in a meshing relationship with the toothed mandrel and thereby form a first set of splines in the sleeve portion while the partial teeth form end depressions in the open end of the sleeve portion between the first set of splines in a manner that maintains the diameter of the sleeve portion the same at the open end thereof as adjacent the end wall;
2. subsequently engage the second group of closer spaced teeth on each forming face with the sleeve portion of the power transmission member to mesh with the first set of splines therein while concomitantly cooperating in a meshing relationship with the toothed mandrel to form a second set of splines in the sleeve portion at the locations of the end depressions intermediate the first set of splines; and
3. finally engage the other first group of farther spaced teeth on each forming face with the splined sleeve portion of the power transmission member to mesh with the formed splines thereof at alternating locations between the splines to correct any out of roundness of the member.

8. A die that is cooperable with a pinion type toothed mandrel to form splines in an annular thin wall power transmission member, said die comprising: a metallic body having a forming face including leading and trailing ends; said forming face having a first group of teeth adjacent the leading end thereof and a second group of teeth toward the trailing end thereof from the leading end; each of said tooth groups including teeth spaced therealong for meshing with the toothed mandrel with the thin wall power transmission member therebetween; and the teeth of the first group being spaced farther from each other than the teeth of the second group whereby the splining of the annular thin wall power transmission member proceeds with the first tooth group forming a first set of splines and the second tooth group meshing with the first set of splines while concomitantly forming a second set of splines intermediate the first set of splines.

9. A die that is cooperable with a pinion type toothed mandrel to form splines in an annular power transmission member including an end wall and a thin wall sleeve portion with an open end opposite the end wall, said die comprising: a metallic body having a forming face including leading and trailing ends; said forming face having a first group of teeth adjacent the leading end thereof and a second group of teeth toward the trailing end thereof from the leading end; each of said tooth groups including teeth spaced therealong for meshing with the toothed mandrel with the thin wall sleeve portion of the power transmission member therebetween; the teeth of the first group being spaced twice as far from each other as the teeth of the second group whereby the splining of the annular thin wall power transmission member proceeds with the first tooth group forming a first set of splines and the second tooth group meshing with the first of splines while concomitantly forming a second set of splines intermediate the first set of splines; and partial teeth located between the farther spaced teeth of the first group so as to form end depressions in the open end of the sleeve portion intermediate the first set of splines in a manner that maintains the diameter of the sleeve portion at the open end thereof the same as adjacent the end wall.

10. A die as claimed in claim 8 wherein the forming face includes another first tooth group located toward the trailing end thereof from the second tooth group and having teeth spaced therealong twice as far from each other as the second tooth group so as to mesh with the formed splines in the sleeve portion of the power transmission member at alternating locations therebetween during unidirectional driving of the die and thereby correcting any out of roundness of the splined sleeve portion.

11. A method for splining an annular thin wall power transmission member, the method comprising: positioning the power transmission member on a toothed pinion type mandrel; meshing die teeth and the mandrel with the power transmission member therebetween to form a first set of splines therein; meshing die teeth with the first set of splines in the power transmission member while concomitantly meshing die teeth and the mandrel between the first set of splines with the power transmission member therebetween to form a second set of splines intermediate the first set; and meshing die teeth with the formed splines while skipping at least alternating locations between the splines to correct any out of roundness of the splined member.

12. A method for splining an annular power transmission member including an end wall and a thin wall sleeve portion having an open end opposite the end wall; the method comprising: positioning the power transmission member on a toothed pinion type mandrel so outwardly projecting teeth of the mandrel engage the interior of the sleeve portion; meshing die teeth and the mandrel teeth with the sleeve portion therebetween to form a first set of splines therein while concomitantly engaging partial teeth with the open end of the sleeve portion between the first set of splines being formed so as to maintain the diameter of the sleeve portion at the open end thereof the same as adjacent the end wall; subsequently meshing die teeth with the first set of splines in the sleeve portion of the power transmission member while concomitantly meshing die teeth and the mandrel teeth between the first set of splines with the sleeve portion therebetween to form a second set of splines in the sleeve portion intermediate the first set of splines; and finally meshing die teeth with the formed splines in the sleeve portion at alternating locations therebetween to correct any out of roundness of the splined sleeve portion of the power transmission member.

13. A method for splining an annular power transmission member including an end wall and a thin wall sleeve portion having an open end opposite the end wall, the method comprising: positioning the power transmission member on a toothed pinion type mandrel so outwardly projecting teeth of the mandrel engage the interior of the sleeve portion; moving a pair of dies having opposed forming faces in a first direction relative to each other and the mandrel mounted member to mesh a first group of teeth on each forming face with the mandrel teeth with the sleeve portion therebetween to form a first set of splines while concomitantly engaging partial teeth with the open end of the sleeve portion to form end depressions between the first set of splines so as to maintain the roundness of the sleeve portion; continuing the die movement in the one direction to mesh a second group of teeth thereof spaced twice as close to each other as the teeth of the first group with the first set of splines while concomitantly engaging the sleeve portion between the first set of splines to mesh with the mandrel teeth with the sleeve portion therebetween and thereby forming a second set of splines intermediate the first set; and continuing to move the dies in the one direction to mesh another group of teeth thereof spaced from each other the same distance as the teeth of the first group with the formed splines of the sleeve portion at alternating locations therebetween to correct any out of roundness of the sleeve portion.

14. A method for splining an annular power transmission member including an end wall and a thin wall sleeve portion having an open end opposite the end wall, the method comprising: positioning the power transmission member on a toothed pinion type mandrel so outwardly projecting teeth of the mandrel engage the interior of the sleeve portion; moving a pair of dies having opposed forming faces in a first direction relative to each other and the mandrel mounted member to mesh a first group of teeth on each forming face with the mandrel teeth with the sleeve portion therebetween to form a first set of splines while concomitantly engaging partial teeth with the open end of the sleeve portion to form end depressions between the first set of splines so as to maintain the roundness of the sleeve portion; continuing the die movement in the one direction to mesh a second group of teeth thereof spaced twice as close to each other as the teeth of the first group with the first set of splines while concomitantly engaging the sleeve portion between the first set of splines to mesh with the mandrel teeth with the sleeve portion therebetween and thereby forming a second set of splines intermediate the first set; and subsequently moving the dies relative to each other and the mandrel mounted member in a second direction opposite the first direction to mesh the teeth of the first group with the formed splines at alternating locations therebetween to correct any out of roundness of the sleeve portion.

* * * * *